United States Patent [19]

Schulmeister et al.

[11] 4,116,171

[45] Sep. 26, 1978

[54] COOLING DEVICE FOR AN INTERNAL COMBUSTION ENGINE

[75] Inventors: Robert Schulmeister; Helmut Roth, both of Friedrichshafen, Fed. Rep. of Germany

[73] Assignee: Motoren-und Turbinen-Union Friedrichshafen GmbH, Fed. Rep. of Germany

[21] Appl. No.: 740,669

[22] Filed: Nov. 10, 1976

[30] Foreign Application Priority Data

Nov. 11, 1975 [DE] Fed. Rep. of Germany ..... 2550481

[51] Int. Cl.[2] ..... F01P 9/04; F01P 7/02; F28F 13/08; F04D 5/00

[52] U.S. Cl. ..... 123/41.57; 123/41.49; 165/125; 415/206; 415/53 R

[58] Field of Search ..... 123/41.56, 41.57, 41.58, 123/41.49, 41.65; 165/125; 415/53 R, 206; 417/243

[56] References Cited

U.S. PATENT DOCUMENTS

| | | | |
|---|---|---|---|
| 914,822 | 3/1909 | Goudard et al. | 123/41.49 |
| 2,171,817 | 9/1939 | Wagner et al. | 123/41.49 |
| 2,300,094 | 10/1942 | Beaven | 123/41.58 |
| 2,668,523 | 2/1954 | Lamb | 123/41.49 |
| 2,808,197 | 10/1957 | Forgo | 415/53 |
| 3,508,842 | 4/1970 | Lievens | 415/53 |
| 3,684,396 | 8/1972 | Ball et al. | 415/206 |
| 3,811,495 | 5/1974 | Laing | 165/125 |
| 3,978,919 | 9/1976 | Fachbach et al. | 165/125 |

FOREIGN PATENT DOCUMENTS

| | | | |
|---|---|---|---|
| 711,813 | 10/1941 | Fed. Rep. of Germany | 123/41.56 |
| 2,435,839 | 7/1974 | Fed. Rep. of Germany | 123/41.49 |

*Primary Examiner*—Charles J. Myhre
*Assistant Examiner*—P. S. Lall
*Attorney, Agent, or Firm*—Craig & Antonelli

[57] ABSTRACT

A cooling device for liquid-cooled internal combustion engines, which device includes an annular radiator core or block which is traversed by the cooling air from the inside thereof toward the outside thereof, with a radial-flow fan or blower equipped with a rotor being arranged on the inside of the annular radiator core or block for axially sucking in the cooling air through an opening provided in a vehicle housing. A second annular radiator core or block for cooling the fuel for the internal combustion engine is disposed concentrically within the first-mentioned annular radiator core or block at a position downstream of the rotor, as viewed in the intake direction of the cooling air. The rotor of the radial-flow fan or blower is constructed such that a communication is provided between each vaned duct of the rotor and an annular rotor side chamber disposed within the second annular radiator core or block to effect a stream of cooling air through the second annular radiator core or block.

18 Claims, 1 Drawing Figure

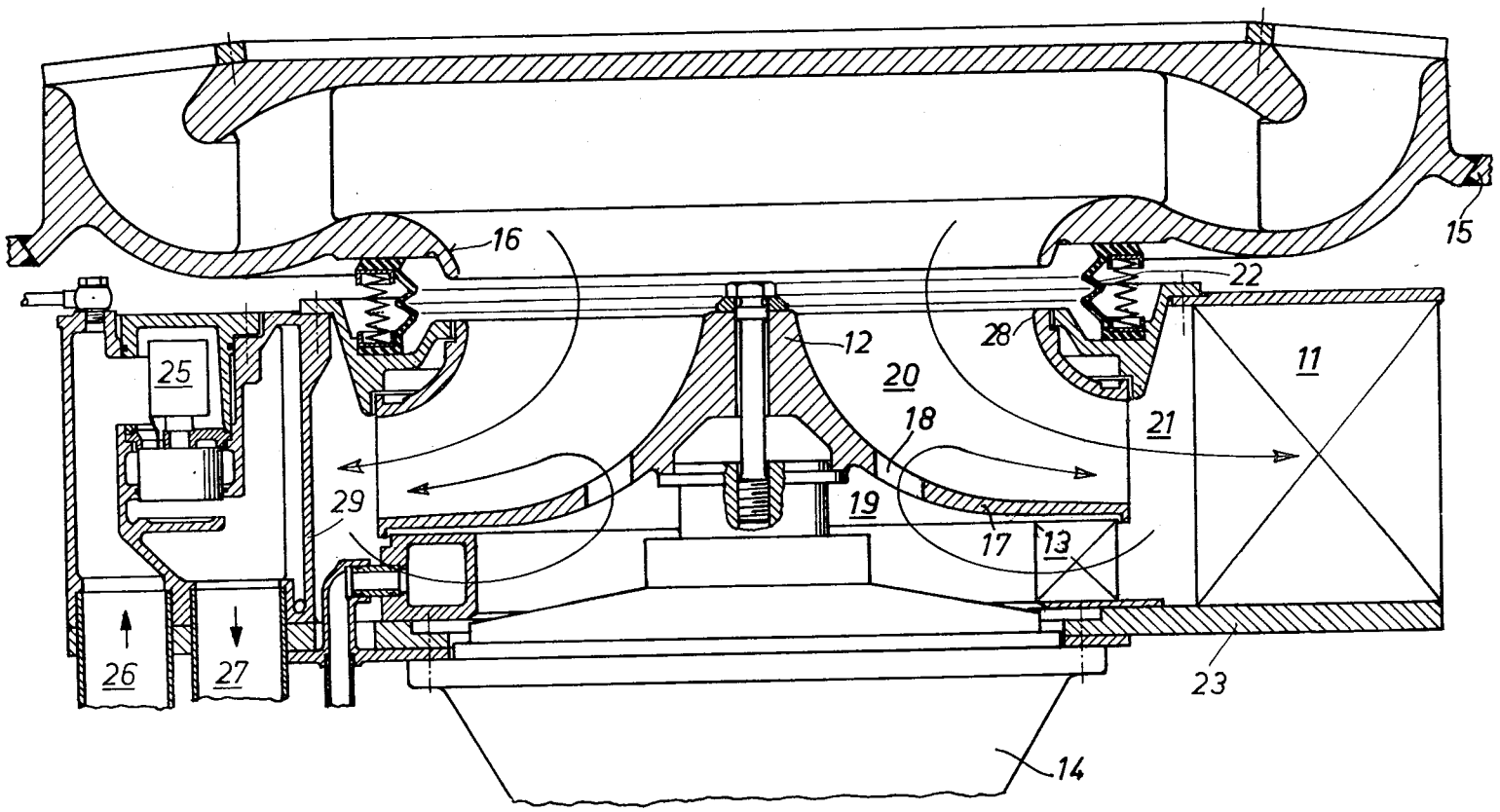
15
11
22
23
21
14
13
28
17
18
20
19
12
16
29
27
25
26

COOLING DEVICE FOR AN INTERNAL COMBUSTION ENGINE

The present invention relates to a cooling arrangement and, more particularly, to a cooling arrangement for the coolant of a liquid-cooled internal combustion engine, which arrangement includes an annular radiator core or cooler block traversed by cooling air from the inside thereof toward the outside thereof with a radial-flow fan or blower provided with a rotor being arranged within the annular radiator or cooler block for drawing in air through an opening of the vehicle housing, and a second annular radiator or cooler block disposed concentrically within the first annular radiator core or cooling block below the rotor of the radial-flow fan or blower.

By means of a cooling arrangement of the aforementioned type, the second cooler block, which must be traversed radially by the cooling air, is arranged on the lee side of the cooling air stream emanating from the rotor of the radial-flow fan or blower. To obtain a satisfactory and effective cooling of the second cooler block, a cooling air by-pass stream is therefor conducted through the second cooler block; however, a sufficient by-pass stream can only be formed if a corresponding pressure gradient exists at the second cooler block between the inlet side and outlet side of the cooling air.

To obtain the necessary pressure gradient, it has been proposed to provide an arrangement wherein auxiliary vanes are provided at a cover plate or back wall of the rotor of a radial-flow fan or blower on the driving or input side of the rotor with the cover plate being arranged adjacent to the second annular radiator or cooler block. By virtue of the provision of the auxiliary vanes, a sub-atmospheric pressure is created within a rotor side chamber arranged within the second cooler block.

While a substantial flow of cooling air through the second cooler is obtained in the proposed arrangement, such flow may not be adequate in all situations.

The present invention is concerned with the task to provide an improved cooling arrangement which is structurally simple and which operates reliably while providing an adequate flow of cooling air through the second cooler block for fuel cooling purposes while avoiding the shortcomings encountered in the prior art.

The underlying problems are solved in accordance with the present invention by providing openings or ducts in a rear or cover plate of the rotor of the radial-flow fan or blower, which openings or ducts connect each vaned duct of the rotor with a rotor side chamber disposed within the second cooler block so as to effect a stream of cooling air through the second cooler block.

The advantages attainable with the present invention reside especially in that a cooling arrangement is provided wherein the cooling output can be increased as compared to the proposed arrangement with the delivery rate of the radial-flow fan or blower being improved due to a flow-enhancing effect of the by-pass stream produced by the openings or ducts with no additional space or structural components being required as constrasted to prior art constructions.

Accordingly, it is an object of the present invention to provide a cooling arrangement for a liquid-cooled internal combustion engine which avoids by simple means the shortcomings and drawbacks encountered in the prior art.

A further object of the present invention resides in providing a cooling arrangement for a liquid-cooled internal combustion engine which is relatively simple in construction and therefor relatively inexpensive to manufacture.

Yet another object of the present invention resides in providing a cooling arrangement for an internal combustion engine which assures a sufficient cooling of the fuel supply cooler block of the internal combustion engine under all operating conditions.

These and further objects, features and advantages of the present invention will become more apparent from the following description when taken in connection with the accompanying drawing which shows, for the purposes of illustration only, one embodiment in accordance with the present invention, and wherein:

The single figure is a somewhat schematic crosssectional view through one embodiment of a cooling arrangement in accordance with the present invention.

Referring now to the single drawing, a cooling arrangement for a liquid-cooled internal combustion engine for use in a vehicle includes an annular radiator or cooler block 11 traversed by cooling air from the inside toward the outside, and of a radial-flow fan rotor or impeller 12 arranged inside of the annular radiator or cooler block 11 for axially drawing in cooling air through an air inlet aperture 16 provided at the vehicle housing or body 15. The rotor or impeller 12 is driven mechanically or hydrodynamically by way of a vehicle transmission 14. A second annular radiator or cooler block 13, for cooling of the fuel of the internal combustion engine, is arranged concentrically within the first ring cooler 11 below or downstream of the radial-flow fan or blower rotor 12, as viewed in the flow direction of the intake cooling air.

The first and second annular radiators or cooler blocks 11, 13, are each constructed of a stack of superimposed corrugated plates which are rigidly secured together as, for axample, by welding.

A flexible line section 22 is arranged as a sealing means for sealing the air supply between the air inlet aperture 16 of the vehicle housing 15 and the rotor inlet 28 and also for compensating for relative movements between the cooling arrangement and the vehicle housing 15.

The outer diameter of the cooling arrangement may be reduced by providing a bladeless annular chamber or space 21 arranged between the rotor or impeller 12 and the annular radiator or cooler block 11, thereby resulting in a weight reduction of the cooling arrangement.

The rotor or impeller 12 is provided with vaned ducts 20 and a rear wall or cover plate 17 arranged on the driving side thereof, with a plurality of openings 18 being provided at the cover plate 17 which are in communication with a rotor side chamber 19, vaned ducts 20, and annular space or chamber 21.

When the radial-flow fan rotor or impeller 12 is being driven by the mechanical transmission 14, approximately the same pressure is built up in the annular rotor side chamber 19 due to the openings 18 as is ambient within the vaned ducts 20 at the location of the openings by virtue of the geometry of the rotor or impeller 12. In any event, the pressure at the openings 18 is lower than the pressure at the outlet side of the rotor or impeller 12 into the annular chamber 21 so that, beginning at the annular chamber 21, a flow or stream of cooling air is directed from the annular chamber 21 outside the second annular radiator or cooling block 13 toward the inside thereof through the cooling block 13 toward the rotor side chamber 19, whereby a closed flow cycle is realized by way of the side chamber 19, openings 18, vaned ducts 20 and annular chamber 21.

The annular radiators or cooling blocks 11, 13 are arranged on a common mounting plate 23 which may be supported at the vehicle transmission 14.

A connecting housing 29 may be provided in which is arranged coolant lines 26, 27 for supplying and removing coolant from the annular radiator or cooling block 11 with a thermostat 25 arranged within the cooler block for controlling the flow of coolant therethrough in a conventional manner.

While we have shown and described only one embodiment in accordance with the present invention, it is understood that the same is not limited thereto, but is susceptible of numerous changes and modifications as shown to those skilled in the art, and we therefor do not wish to be limited to the details shown and described herein, but intend to cover all such changes and modifications as are encompassed by the scope of the appended claims.

We claim:

1. A cooling arrangement for a liquid-cooled internal combustion engine, the arrangement including a first annular cooler means traversed by a flow of cooling air from the inside of said annular cooler means to the outside thereof, a radial-flow fan means having a rotor means arranged within the first annular cooler means for axially drawing in cooling air from an air intake means, a second annular cooler means arranged downstream of said radial-flow fan means, as viewed in the intake flow direction, for cooling of fuel of the internal combustion engine, characterized in that the rotor means includes a rotor inlet means for communicating with the intake openings and a wall member, at least a portion of which is interposed between the rotor inlet means and the second annular cooler means so as to define a rotor side chamber means, and in that means are provided in said rotor means for communicating said rotor side chamber means with said rotor inlet means so as to effect a flow of cooling air through said second annular cooler means.

2. A cooling arrangement according to claim 1, characterized in that the portion of the wall member of said rotor means forms a rear wall thereof, as viewed in the intake flow direction of cooling air, and in that said communicating means includes at least one opening provided in said rear wall.

3. A cooling arrangement according to claim 2, characterized in that a plurality of openings are provided in said rear wall, and in that an annular chamber is interposed between said first annular cooler means and a discharge end of said rotor means, said annular chamber communicating with said rotor means and said rotor side chamber means such that a flow of cooling air is directed from the discharge end of said rotor means into said annular chamber and through said second annular cooler means from the outside of said second annular cooler means to the inside thereof toward said rotor side chamber means.

4. A cooling arrangement according to claim 3, in a vehicle including a vehicle body, characterized in that the air intake means is an opening provided in the vehicle body.

5. A cooling arrangement according to claim 4, characterized in that the vehicle includes a vehicle transmission means, and in that the rotor means is driven by the vehicle transmission means.

6. A cooling arrangement according to claim 5, characterized in that the rotor means is mechanically driven from the transmission means.

7. A cooling arrangement according to claim 5, characterized in that the rotor means is hydrodynamically driven from the transmission means.

8. A cooling arrangement according to claim 3, characterized in that a flexible seal means is provided for sealing the air supply between the air inlet opening means and the rotor inlet means.

9. A cooling arrangement according to claim 1, characterized in that said communicating means includes a plurality of spaced apertures provided in the portion of the wall member of the rotor means interposed between the rotor inlet means and the second annular cooler means.

10. A cooling arrangement according to claim 8, characterized in that an annular chamber is interposed between said fist annular cooler means and a discharge end of said rotor means, said annular chamber communicating with said rotor means and said rotor side chamber means such that a flow of cooling air is directed from the discharge end of said rotor means into said annular chamber and through said second annular cooler means from the outside of said second annular cooler means to the inside thereof toward said rotor side chamber means.

11. A cooling arrangement according to claim 10, in a vehicle including a vehicle transmission, characterized in that the rotor means is driven by the vehicle transmission means.

12. A cooling arrangement according to claim 11, characterized in that the rotor means is mechanically driven from the transmission means.

13. A cooling arrangement according to claim 10, characterized in that the rotor means is hydrodynamically driven from the transmission means.

14. A cooling arrangement according to claim 1, characterized in that a flexible seal means is provided for sealing the air supply between the air inlet opening means and the rotor inlet means.

15. A cooling arrangement according to claim 14, characterized in that an annular chamber is interposed between said first annular cooler means and a discharge end of said rotor means, said annular chamber communicating with said rotor means and said rotor side chamber means such that a flow of cooling air is directed from the discharge end of said rotor means into said annular chamber and through said second annular cooler means from the outside of said second annular cooler means to the inside thereof toward said rotor side chamber means.

16. A cooling arrangement according to claim 15, characterized in that said communicating means includes a plurality of spaced apertures provided in the portion of the wall member of the rotor means interposed between the rotor inlet means and the second annular cooler means.

17. A cooling arrangement according to claim 1, characterized in that an annular chamber is interposed between said first annular cooler means and a discharge end of said rotor means, said annular chamber communicating with said rotor means and said rotor side chamber means such that a flow of cooling air is directed from the discharge end of said rotor means into said annular chamber and through said second annular cooler means from the outside of said second annular cooler means to the inside thereof toward said rotor side chamber means.

18. A cooling arrangement for a liquid-cooled internal combustion engine, the arrangement including a first annular cooler means traversed by a flow of cooling air from the inside of said annular cooler means to the outside thereof, a radial-flow fan means having a rotor means arranged within the first annular cooler means for axially drawing in cooling air from an air intake means, a second annular cooler means arranged downstream of said radial-flow fan means, as viewed in the intake flow direction, for cooling of fuel of the internal combustion engine, characterized in that the rotor means includes a rotatably mounted impeller having an inlet end, a discharge end, and a cover plate, said cover plate being interposed between the inlet end and the second annular cooler means so as to define a chamber between the second annular cooler means and said cover plate, and in that means are provided in said cover plate for communicating the chamber with said inlet end so as to effect a flow of cooling air through said second annular cooler means.

* * * * *